US007640624B2

(12) United States Patent
Crouch et al.

(10) Patent No.: US 7,640,624 B2
(45) Date of Patent: Jan. 5, 2010

(54) DIRT CUP WITH DUMP DOOR IN BOTTOM WALL AND DUMP DOOR ACTUATOR ON TOP WALL

(75) Inventors: James T. Crouch, Danville, KY (US); Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 764 days.

(21) Appl. No.: 11/104,711

(22) Filed: Apr. 13, 2005

(65) Prior Publication Data

US 2005/0229355 A1 Oct. 20, 2005

Related U.S. Application Data

(60) Provisional application No. 60/563,272, filed on Apr. 16, 2004.

(51) Int. Cl.
*A47L 9/10* (2006.01)

(52) U.S. Cl. ..... 15/352; 55/428; 55/429; 55/DIG. 3

(58) Field of Classification Search ..... 15/350–353; 55/429, 459.1, DIG. 3, 428
See application file for complete search history.

(56) References Cited

U.S. PATENT DOCUMENTS

| | | | | |
|---|---|---|---|---|
| 2,082,291 | A | 6/1937 | Jeannerette | |
| 2,432,757 | A | 12/1947 | Weniger | |
| 3,896,945 | A | 7/1975 | Bjorklund et al. | |
| 3,982,641 | A | 9/1976 | Miller | |
| 3,997,089 | A | 12/1976 | Clarke et al. | |
| 5,282,319 | A | 2/1994 | Casquilho et al. | |
| 6,192,550 | B1 * | 2/2001 | Hamada et al. | 15/352 |
| 6,406,505 | B1 | 6/2002 | Oh et al. | |
| 6,546,593 | B2 * | 4/2003 | Oh et al. | 15/353 |
| 6,553,882 | B1 | 4/2003 | Daley, Jr. et al. | |
| 6,615,444 | B2 | 9/2003 | McGilll et al. | |
| 6,637,346 | B2 | 10/2003 | Gaydos | |
| 7,018,439 | B2 * | 3/2006 | Vuijk | 55/429 |
| 7,134,165 | B2 * | 11/2006 | Pullins | 15/352 |
| 2003/0121121 | A1 | 7/2003 | Nakai et al. | |
| 2004/0068827 | A1 | 4/2004 | Dyson | |
| 2004/0074213 | A1 | 4/2004 | Organ | |
| 2004/0111824 | A1 | 6/2004 | Vuijk | |
| 2004/0112018 | A1 | 6/2004 | Vuijk | |
| 2004/0112022 | A1 * | 6/2004 | Vuijk | 55/429 |
| 2004/0144070 | A1 | 7/2004 | Gammack et al. | |

FOREIGN PATENT DOCUMENTS

| | | |
|---|---|---|
| JP | 56-136642 | 10/1981 |
| JP | 56-136650 | 10/1981 |

* cited by examiner

*Primary Examiner*—David A Redding
(74) *Attorney, Agent, or Firm*—King & Schickli, PLLC

(57) ABSTRACT

A floor cleaning appliance includes a housing carrying both a suction generator and a dirt cup. The dirt cup includes a sidewall, a top wall and a dump door. A latch is provided to secure the dump door in a closed position. An actuator for releasing that latch is remotely positioned on the top wall. A linkage is carried on the sidewall and operatively connects the actuator with the latch.

20 Claims, 8 Drawing Sheets

Fig. 7
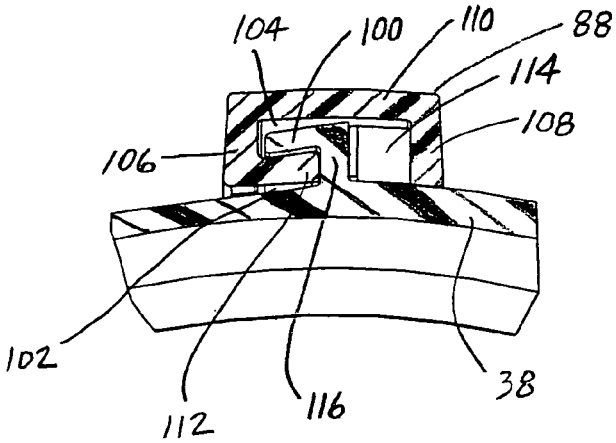
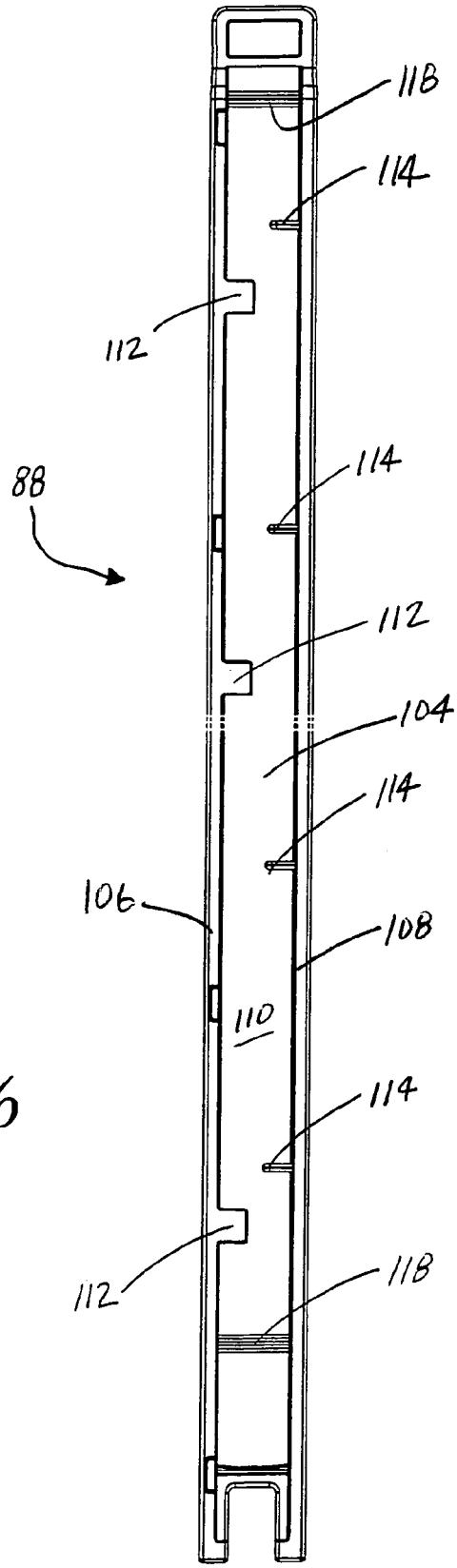
Fig. 6

DIRT CUP WITH DUMP DOOR IN BOTTOM WALL AND DUMP DOOR ACTUATOR ON TOP WALL

This application claims the benefit of U.S. Provisional Patent Application Ser. No. 60/563,272 filed on 16 Apr. 2004.

TECHNICAL FIELD

The present invention relates generally to the floor care equipment field and, more particularly, to a floor care appliance incorporating a novel dirt cup.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber in a dirt cup that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dust collection assembly for a floor care appliance such as an upright or canister vacuum cleaner or even an extractor.

SUMMARY OF THE INVENTION

In accordance with the purposes of the present invention as described herein, a new and improved floor care appliance is provided. That floor care appliance includes a housing, a suction generator carried on the housing and a dirt cup carried on the housing. The dirt cup is provided to collect dirt and debris drawn into the appliance by the suction generator.

The dirt cup is characterized by a sidewall, a bottom wall and a top wall. The bottom wall includes a dump door having a latch for securing the dump door in a closed position. The top wall includes an actuator for releasing the latch and opening the dump door in order to empty the contents from the dirt cup into an underlying trash receptacle. The sidewall carries a linkage for operatively connecting the actuator to the latch.

More specifically describing the invention, the top wall includes a carrying handle. The actuator may be provided on the carrying handle if desired. Still further, the carrying handle may be made to pivot relative to a main body of the top wall. Further, the carrying handle includes a cavity and the actuator includes an elongated lug that extends through the cavity.

The linkage on the sidewall includes an elongated member mounted so as to allow sliding movement relative to the sidewall. This sliding movement may be provided in a number of ways including a cooperating guide track and channel arrangement wherein either the guide track or the channel is provided on the elongated member and the other of the guide track or channel is provided on the sidewall.

The elongated member includes a first end engaging the elongated lug of the actuator and a second end for engaging the latch. The second end may be provided with a cam surface.

The latch includes a locking element that engages a locking tab when the dump door is in the closed position. In one possible embodiment the latch is resilient. The sidewall carries either the locking tab or the locking element and the other of the locking tab and the locking element is provided on the dump door.

The bottom wall includes a frame. The dump door is connected to the frame by a hinge. The frame includes a mounting flange engaging the sidewall and securing the bottom wall to the sidewall.

In one possible embodiment the top wall is a lid. The main body of the top wall includes a mounting skirt that engages the sidewall and secures the top wall thereto.

In accordance with another aspect of the present invention a method is provided for constructing a dirt cup for a floor care appliance. The method comprises the steps of providing a dirt cup with a top wall, a bottom wall and a sidewall, positioning a dump door in the bottom wall and positioning an actuator for opening the dump door on the top wall.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification illustrates several aspects of the present invention and together with the description serves to explain certain principles of the invention. In the drawing:

FIG. 6 is a rear plan view of the linkage element that extends along the sidewall of the dirt cup; and FIG. 7 is a detailed cross sectional view illustrating how the linkage element is mounted to allow sliding movement relative to the sidewall of the dirt cup.

Reference will now be made in detail to the present preferred embodiment of the invention, an example of which is illustrated in the accompanying drawings.

DETAILED DESCRIPTION OF THE INVENTION

Figure 1:
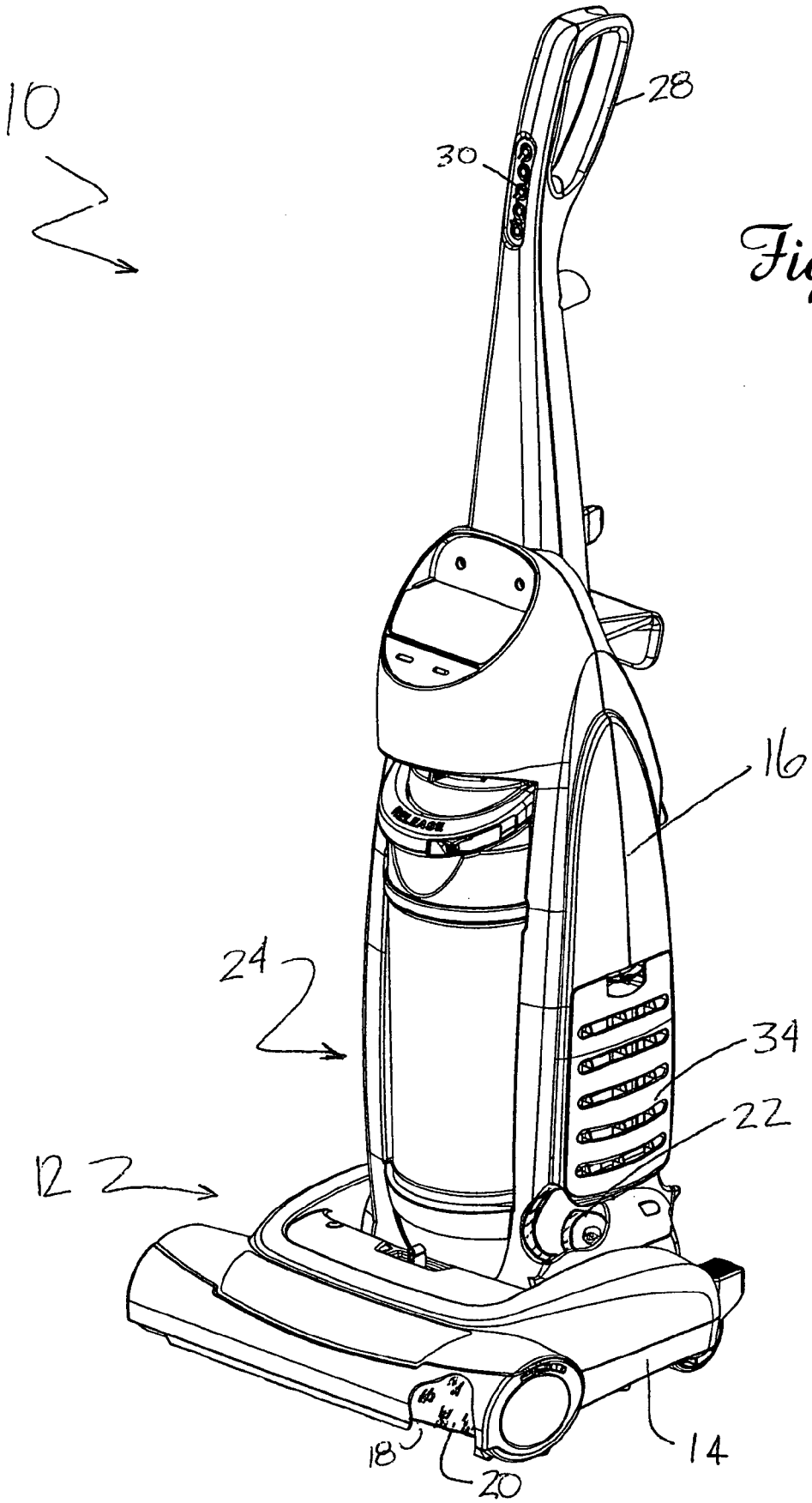
FIG. 1 is a perspective view of one possible embodiment of a floor care appliance of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent also covers other floor cleaning appliances such as canister vacuum cleaners and extractors.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner 10 to and fro across the floor. Wheels (not shown) carried on the housing 12 allow the vacuum cleaner 10 to be moved smoothly across the floor. As illustrated, the nozzle section 14 is equipped with a nozzle inlet 18. In the illustrated embodiment, the nozzle inlet 18 also includes a rotary agitator 20.

Figure 4A:
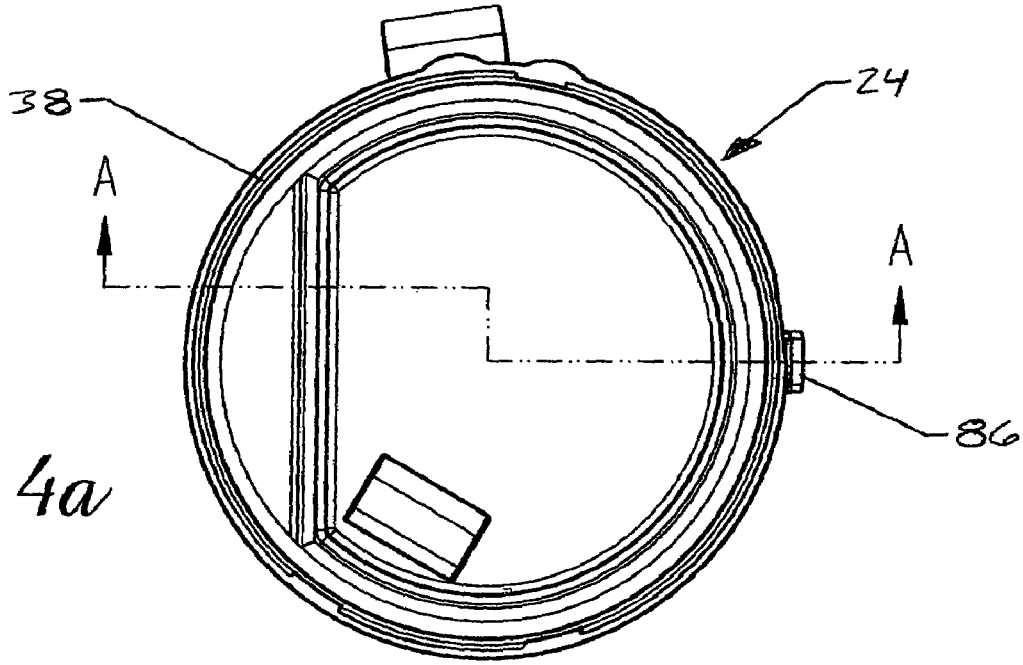
FIG. 4*a* is a top plan view of the dirt cup with the upper wall or lid removed.
Figure 4B:
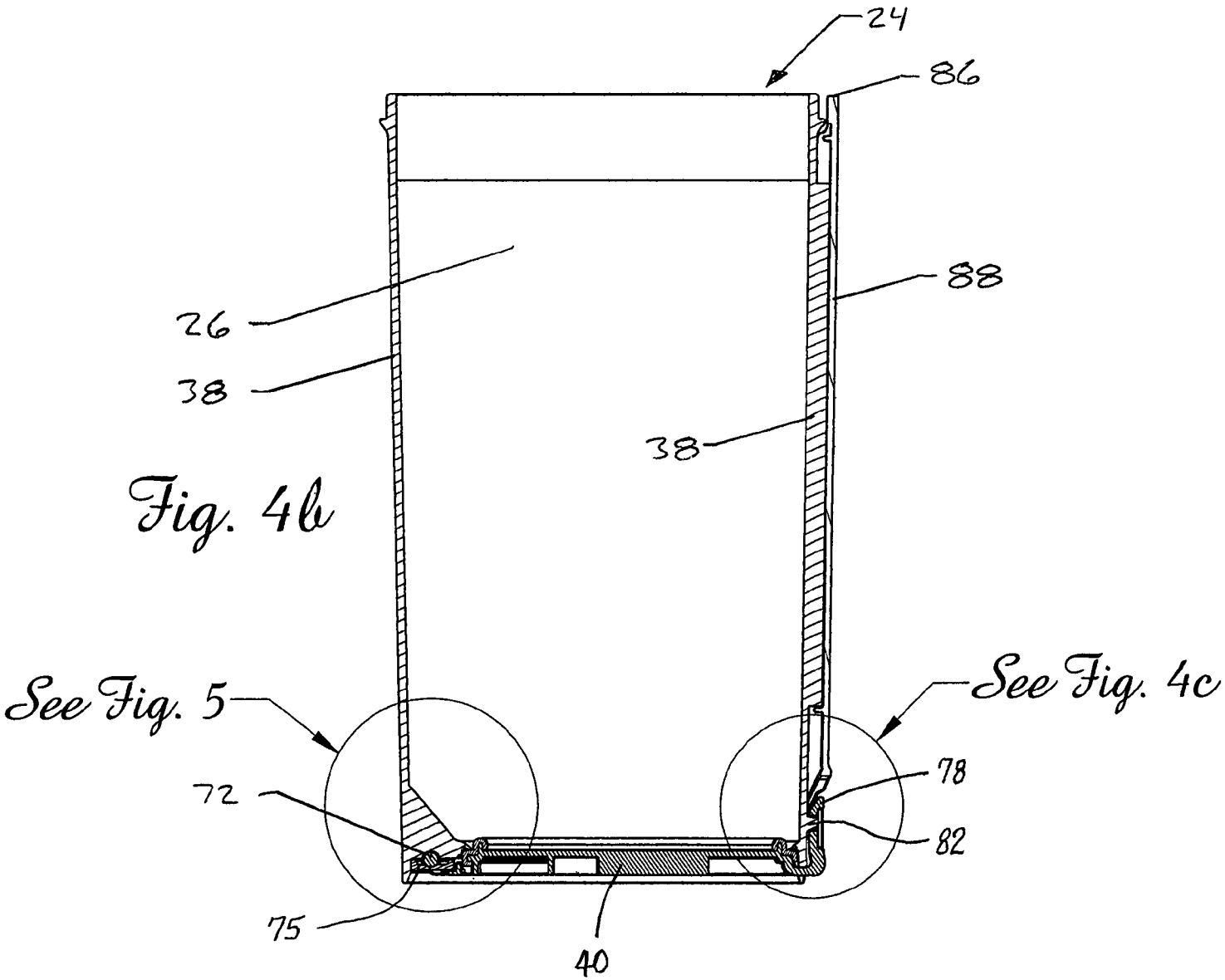
FIG. 4*b* is a cross sectional view of the dirt cup shown in FIG. 4*a* along line AA also including a detailed illustration of the dump door latching arrangement.

The canister section 16 houses a suction generator 22 (i.e. a fan and motor assembly) and a dirt cup 24 having a dirt collection chamber 26 (see also FIG. 4*b*). The canister section 16 also includes a control handle 28 and an actuator switch 30 for controlling the operation of the vacuum cleaner 10 and thereby driving the rotary agitator 20 and the suction generator 22 as desired. In the illustrated embodiment the actuator switch 30 comprises a series of touch controls.

During the cleaning operation the rotary agitator 20 brushes and beats dirt and debris from the nap of an underlying carpet being cleaned. The dirt and debris are then drawn by the suction generator 22 through the nozzle inlet 18 into the dirt cup 24 and through any filter element (not shown) that might be provided in the dirt cup. Dirt and debris are collected in the dirt collection chamber 26. The airstream is then directed over the motor of the suction generator 22 to provide cooling before being routed through a final filter, to remove any carbon particles stripped from the brushes of the motor by the airstream, before exhausting the airstream through an exhaust port 34 into the environment.

Figure 2A:
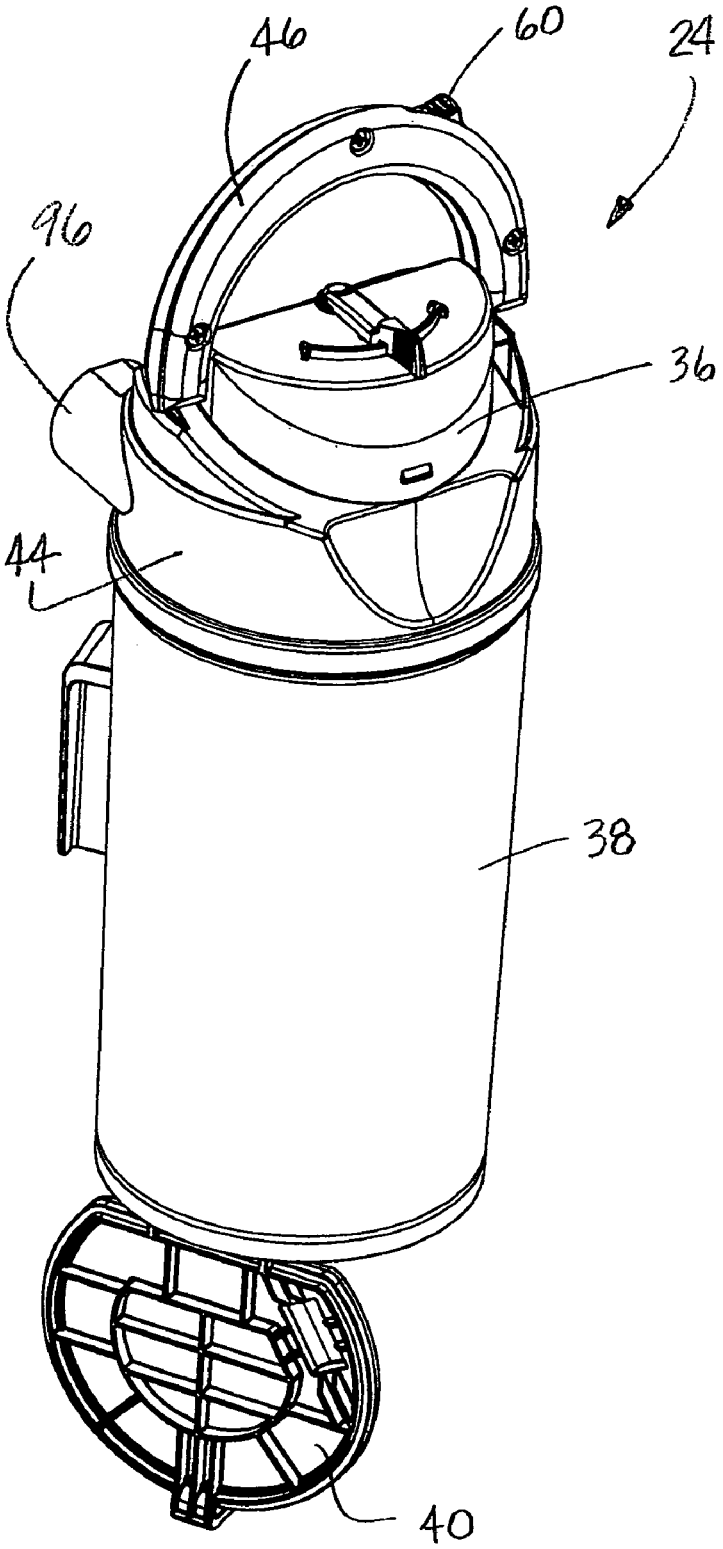
FIGS. 2*a* and 2*b* are perspective views of the dirt cup removed from the vacuum cleaner with FIG. 2*a* illustrating the pivoting handle raised and the dump door open and FIG. 2*b* illustrating the pivoting handle lowered and the dump door closed.
Figure 2B:
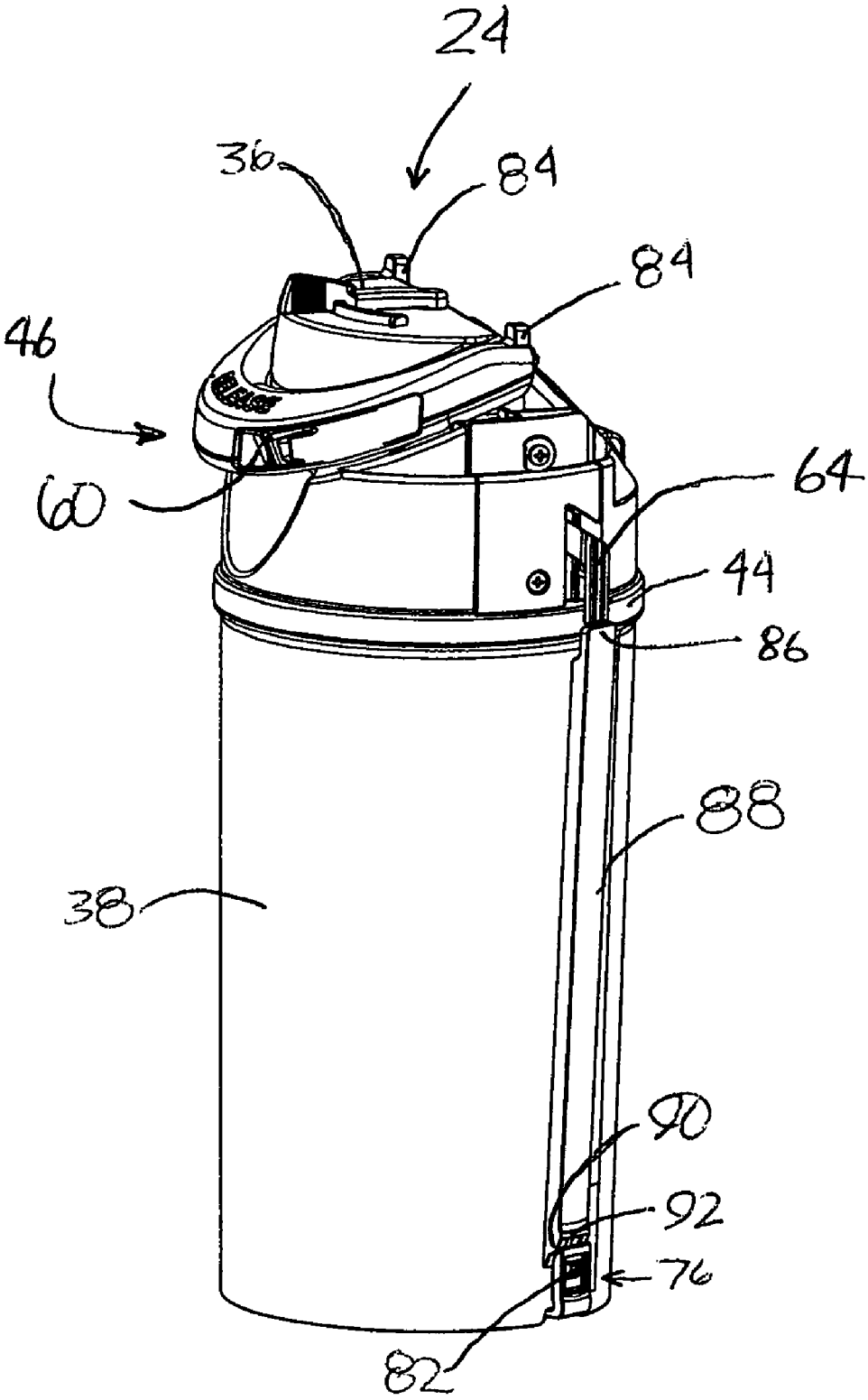
Figure 3:
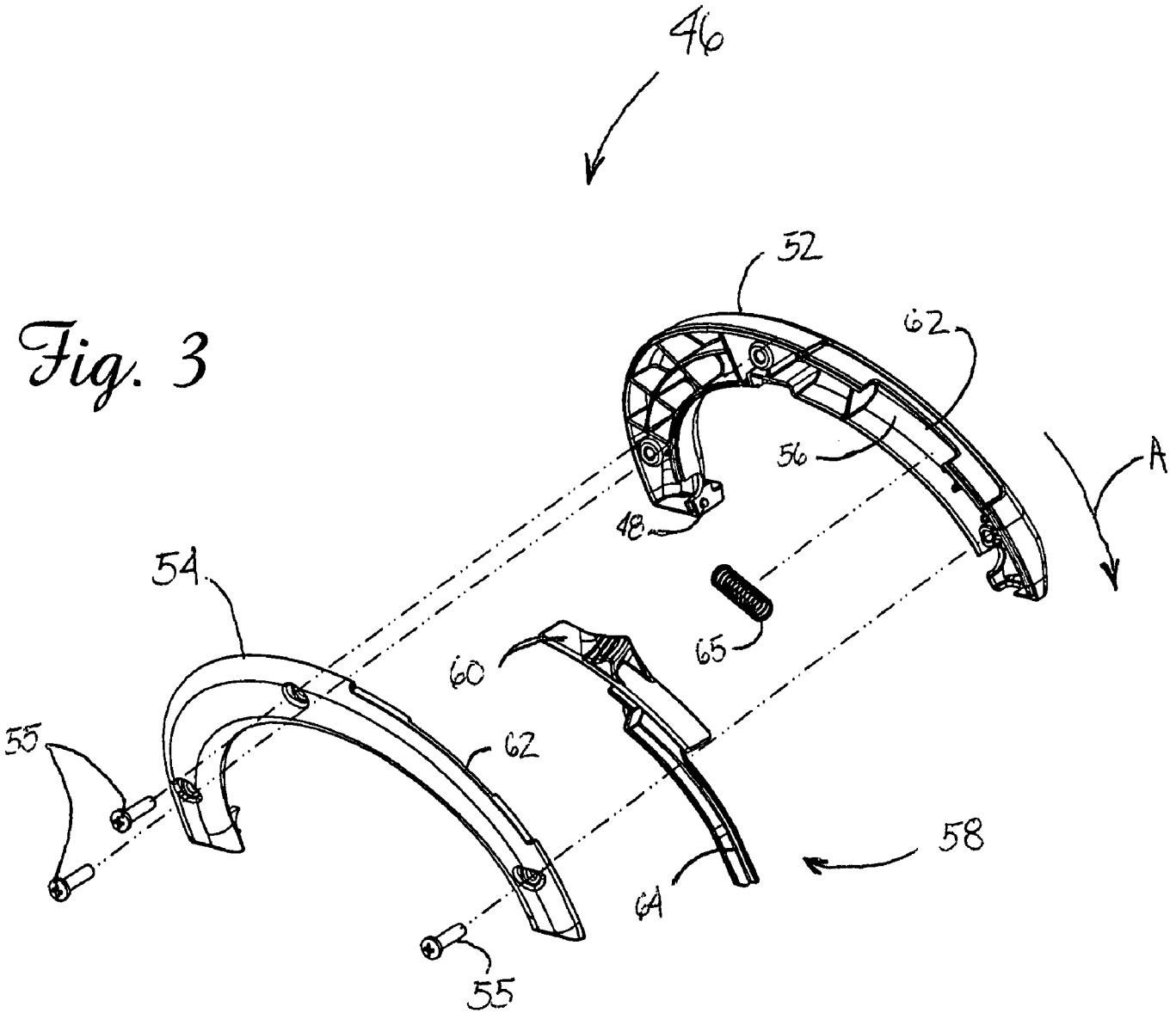
FIG. 3 is a detailed exploded view of the pivoting handle and the actuator.

The dirt cup 24 will now be described in detailed. As illustrated in FIGS. 2*a*, 2*b*, 4*a*-4*c* and 5, the dirt cup includes a top wall 36, a sidewall 38 and a dump door 40. In the illustrated embodiment the top wall 36 is a lid comprising a main body having a mounting skirt 44 that threads or snaps onto the sidewall 38. As best illustrated in FIGS. 2*a*, 2*b* and 3, the top wall 36 also includes a carrying handle 46. The carrying handle 46 is arcuate in shape and includes an inwardly projecting pivot pin 48 at each end. Each pivot pin 48 is captured in a notch provided in the top wall 36 so that the handle 46 is allowed to freely pivot relative to the main body. As best illustrated in FIG. 3, the handle 46 includes a first section 52 and a second section 54 connected together by fasteners such as screws 55. A cavity 56 is formed between the two handle sections 52, 54.

A dump door actuator 58 is carried by the handle 46. The dump door actuator 58 includes a sliding actuator switch 60 that is received in and runs along the guide track 62 formed by the two handle sections 52, 54. Additionally, the dump door actuator 58 includes an elongated lug 64 extending from the actuator switch 60 and a biasing spring 65 held in the cavity 56 and received over the lug 64. As illustrated in FIG. 3 the lug 64 extends through the cavity 56 to the end of the handle 46.

Figure 4C:
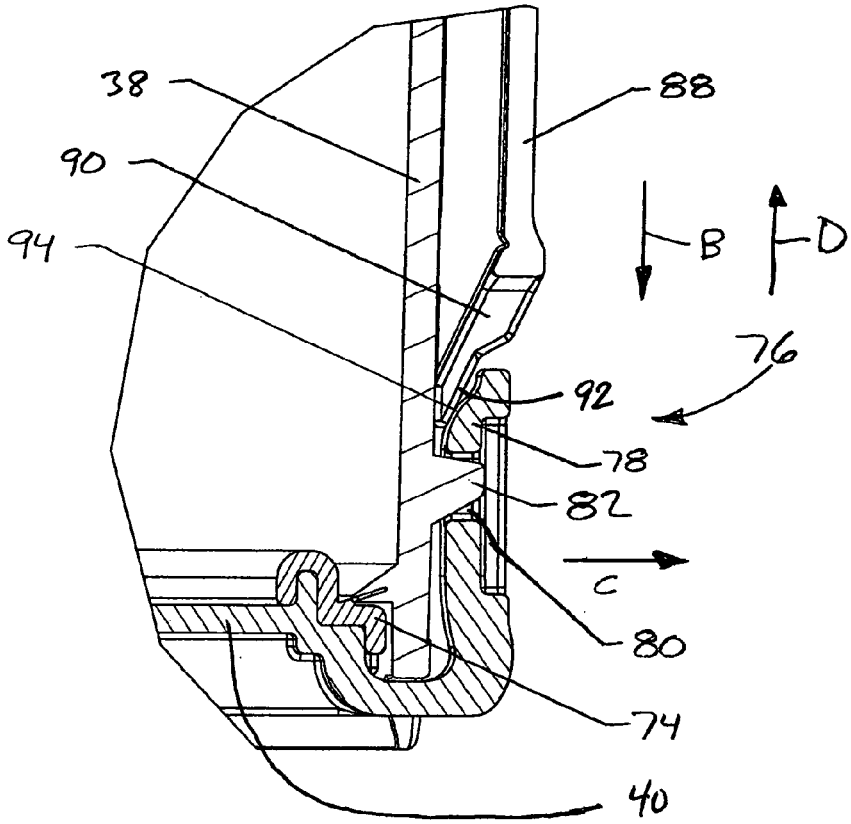
FIG. 4*c* is a detailed front elevational view of that latching arrangement shown in FIG. 4*b;*
Figure 5:
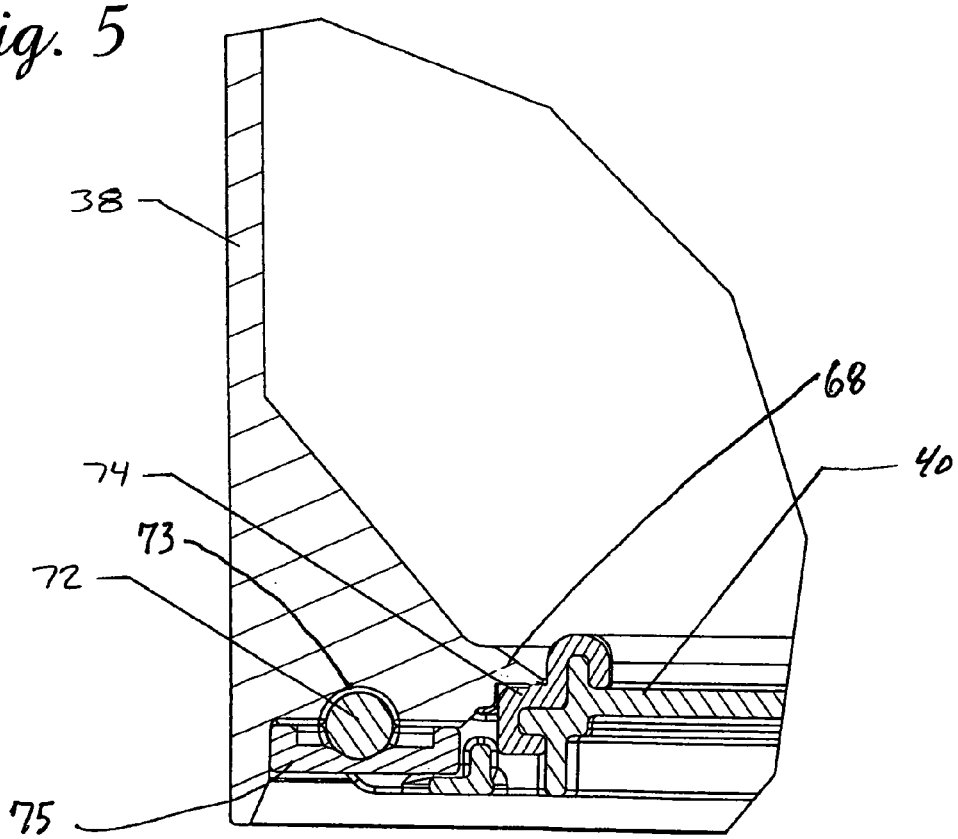
FIG. 5 provides detailed cross sectional view of the dump door hinge and latch assemblies.

As illustrated in FIG. 5, the bottom wall or dump door 40 is connected by means of hinge 72 at one side thereof to the sidewall 38 of the dirt cup 24. More specifically, the hinge 72 is received in a cooperating cavity 73 formed in the sidewall 38. A bracket 75 functions to overlie the hinge 72 and capture it in the cavity 73. The bracket 72 is secured to the sidewall by means of a screw or other fastener (not shown). When the dump door 40 is closed, a seal 74 extending around the entire periphery of the dump door sealingly engages a lip 68 on the sidewall 38 so as to seal the dirt cup 24 and prevent the passage of air, dust and dirt from the dirt cup into the environment A latch, generally designated by reference numeral 76, is provided at the side of the dump door 40 oppositive the hinge 72 (see FIG. 4*c*). In the illustrated embodiment the latch 76 comprises a cooperating locking tab 82 and a resilient locking element 78 made from plastic or other appropriate material. As best illustrated in FIGS. 2*a* and 4*c*, the resilient locking element 78 is substantially U-shaped and includes an aperture 80 for receiving and holding the locking tab 82 carried by the sidewall 38 of the dirt cup 24. Thus, when the dump door 40 is in the closed position the locking element 78 is engaging the locking tab 82. This causes the seal 74 around the dump door 40 to seat against the lip 68 thereby closing the dirt cup 24. This is the position of the dump door 40 when the dirt cup 24 is mounted in the canister section 16 and the vacuum cleaner 10 is operated to clean a floor.

At some point during or following floor cleaning, it may become necessary or desirable to empty the dirt cup 24. In order to achieve this end the dirt cup 24 is first removed from the canister section 16. This can be done by engaging the carrying handle 46 (then in a position shown in FIG. 2*b*) with the fingers and pivoting the handle up slightly from the seated position. As the handle pivots the latching lugs 84 are released from the canister section 16 thereby allowing the dirt cup 24 to be freely removed from the vacuum cleaner 10. During the removal operation it should be appreciated that the dump door 40 remains closed and sealed at all times.

After positioning the dirt cup 24 over a trash can, garbage can or other dirt receptacle, the operator engages the dump door actuator 58 in order to open the dump door 40 and empty the dirt cup 24. More specifically, the operator presses a finger against the sliding actuator 60 and slides the dump door actuator 58 along the guide track 62 in the direction of action arrow A (see FIG. 3) against the biasing force of the spring 65. This causes the lug 64 of the dump door actuator 58 to be extended further from the cavity 56 in the carrying handle 46. The end of the lug 64 engages a first end 86 of a linkage element 88 mounted on the sidewall 38 of the dirt cup 24. More specifically, the linkage element 88 is mounted so as to allow free sliding movement relative to the sidewall 38. This may be accomplished by substantially any means known in the art including but not limited to cooperating rails and channels provided on the linkage element 88 and the exterior surface of the sidewall 38.

In the embodiment illustrated in FIGS. 6 and 7, the sidewall 38 includes a substantially L-shaped guide track 100 that forms a channel 102. The linkage element 88 includes a cavity 104 formed by the two sidewalls 106, 108 and the top wall 110. A guide track follower includes a first series of guide tabs 112 extending from the first sidewall 106 and a second series of guide tabs 114 extending from the sidewall 108. As illustrated, the first series of guide tabs 112 are captured for free sliding movement in the channel 102 of the guide track 100. Simultaneously, the second series of guide tabs 114 engage the upstanding post 116 of the guide track to effectively hold the first series of guide tabs 112 in the channel 102. Two stops 118, one adjacent each end of the linkage element 88, engage the ends of the guide track 100 to limit the range or extent of the sliding movement of the linkage element 88 on the guide track 100.

As the lug 64 is moved in the direction of action arrow A, it engages the first end 86 of the linkage element 88 and forces the linkage element downward along the sidewall 38 of the dirt cup in the direction of action arrow B (note FIG. 4*c*). As this occurs the second end 90 of the linkage element 88 engages the locking element 78 of the latch 76. More specifically, as best illustrated in FIG. 4*c* the second end 90 of the linkage element 88 includes a cam surface 92 that cooperatively engages a cam surface 94 carried on the locking element 78. This forces the locking element 78 in an outward direction (note action arrow C) until the locking element is clear of the locking tab 82. At that point in time the force of gravity acting upon the dump door 40 and the dirt and debris in the dirt cup 24 causes the dump door to swing open (note FIG. 2*a* ) and the dirt and debris falls from the collection chamber 26 of the dirt cup into the underlying trash receptacle.

After the dirt cup 24 has been emptied, the dump door 40 is pivoted closed and the locking element 78 is resiliently latched to the locking tab 82 to hold the dump door in the closed position. The linkage element 88 is free to shift upward in the direction of action arrow D in FIG. 4*c* since the biasing spring 65 previously returned the dump door actuator to the home or locked position. The dirt cup 24 is then reinserted in the canister section 16 and the vacuum cleaner 10 is again ready for operation.

In summary, numerous benefits result from employing the concepts of the present invention. By locating the dump door actuator 58 on the handle 46 where the actuator switch 60 may be readily engaged with the thumb, the dirt cup 24 may be conveniently emptied with use of a single hand. The linkage element 88 is mounted for sliding movement on the exterior sidewall 38 of the dirt cup 24 where it is isolated from dirt and debris held inside the dirt cup. As a consequence, the possibility of that dirt and debris interfering or jamming proper operation of that linkage is absolutely avoided.

The foregoing description of a preferred embodiment of the present invention has been presented for purposes of illustration and description. It is not intended to be exhaustive or to limit the invention to the precise form disclosed. Obvious modifications or variations are possible in light of the above teachings. For example, as illustrated in FIGS. 2*a* and 2*b*, the sidewall 38 is round and the dirt cup 24 is cylindrical in shape. Further, the dirty air inlet 96 provided in the sidewall 38 is tangentially oriented in order to provide cyclonic air flow in the dirt cup 24. While the illustrated embodiment provides cyclonic air flow, it should be appreciated that the present invention is not limited to dirt cups providing cyclonic air flow. In fact, the inlet could be provided in the sidewall in an orientation other than tangential or in the top wall. Similarly, the outlet from the dirt cup could be provided in the sidewall or the top wall as desired. Further, while a single, round sidewall 38 is disclosed and illustrated, it should be appreciated that the sidewall could be polygonal if desired. Still further, it should be appreciated that while the illustrated embodiment shows the locking tab 82 on the sidewall 38 of the dirt cup 24 and the resilient locking element 78 on the dump door 40, the relative positions of the locking tab and locking element could be reversed if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A floor cleaning appliance, comprising:

a housing;

a suction generator carried on said housing; and a dirt cup carried on said housing to collect dirt and debris drawn into said appliance by said suction generator;

said dirt cup being characterized by a sidewall, a top wall and a dump door, said dirt cup carrying at least a portion of a latch for securing said dump door in a closed position, said top wall including an actuator for releasing said latch and opening said dump door and said sidewall carrying a linkage for operatively connecting said actuator to said latch.

2. The floor cleaning appliance of claim 1, wherein said linkage is carried on an exterior surface of said sidewall.

3. The floor cleaning appliance of claim 1 wherein said top wall includes a carrying handle.

4. The floor cleaning appliance of claim 3, wherein said actuator is provided on said carrying handle.

5. The floor cleaning appliance of claim 4, wherein said carrying handle pivots relative to a main body of said top wall.

6. The floor cleaning appliance of claim 5, wherein said carrying handle includes a cavity and said actuator is received in said cavity.

7. The floor cleaning appliance of claim 6, wherein said actuator includes an elongated lug extending through said cavity.

8. The floor cleaning appliance of claim 7, wherein said linkage includes an elongated member mounted so as to allow sliding movement relative to said sidewall.

9. The floor cleaning appliance of claim 8 wherein said sidewall includes a guide track and said elongated member includes a guide track follower.

10. The floor cleaning appliance of claim 9 wherein said guide track is substantially L-shaped and defines a channel with said sidewall.

11. The floor cleaning appliance of claim 10 wherein said elongated member includes a first sidewall, a second sidewall and a top wall forming a cavity holding said guide track follower and said guide track follower includes a first series of guide tabs extending from said first sidewall and a second series of guide tabs extending from said second sidewall, said first series of guide tabs being received for free sliding movement in said channel.

12. The floor cleaning appliance of claim 8, wherein said elongated member includes a first end engaging said elongated lug of said actuator and a second end engaging said latch.

13. The floor cleaning appliance of claim 12, wherein said second end has a cam surface.

14. The floor cleaning appliance of claim 10, wherein said latch includes a cooperating locking tab and locking element.

15. The floor cleaning appliance of claim 14, wherein said locking element is resilient.

16. The floor cleaning appliance of claim 15, wherein one of said locking tab and said locking element is mounted on said sidewall and the other of said locking tab and said locking element is mounted on said dump door.

17. The floor cleaning appliance of claim 15, wherein said sidewall carries said locking tab and said dump door carries said locking element, said locking element engaging said locking tab when said dump door is in a closed position.

18. The floor cleaning appliance of claim 16, wherein said dump door is connected to said sidewall by a hinge.

19. The floor cleaning appliance of claim 18, wherein said top wall is a lid and said main body includes a mounting skirt that engages said sidewall and secures said top wall thereto.

20. A method of constructing a dirt cup for a floor cleaning appliance, comprising:

providing a dirt cup with a top wall, a sidewall and a dump door;

positioning an actuator for opening said dump door on said top wall; and positioning at least a portion of a latch for said dump door on said dump door; and positioning a linkage between said actuator and said latch on said sidewall.

* * * * *